US011202514B1

(12) United States Patent
Blakely

(10) Patent No.: US 11,202,514 B1
(45) Date of Patent: Dec. 21, 2021

(54) VENTILATED MATTRESS CORE

(71) Applicant: Under Armour, Inc., Baltimore, MD (US)

(72) Inventor: Kyle Blakely, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 537 days.

(21) Appl. No.: 16/101,722

(22) Filed: Aug. 13, 2018

Related U.S. Application Data

(60) Provisional application No. 62/544,055, filed on Aug. 11, 2017.

(51) Int. Cl.

| | |
|---|---|
| ***A47C 27/05*** | (2006.01) |
| ***A47C 27/14*** | (2006.01) |
| ***A47C 27/06*** | (2006.01) |
| ***A47C 31/00*** | (2006.01) |

(52) U.S. Cl.
CPC ..... *A47C 27/05* (2013.01); *A47C 27/064* (2013.01); *A47C 27/14* (2013.01); *A47C 31/001* (2013.01); *A47C 31/006* (2013.01)

(58) Field of Classification Search
CPC ..... A47C 27/002; A47C 27/05; A47C 27/056; A47C 27/121; A47C 27/127; A47C 27/15; A47C 27/20; A47C 27/22; A47C 31/006; A47C 31/001; A61G 5/1043–1048; A61G 7/057–0755
See application file for complete search history.

(56) References Cited

U.S. PATENT DOCUMENTS

| | | | | |
|---|---|---|---|---|
| 4,316,298 | A | 2/1982 | Russo et al. | |
| 7,886,385 | B2 | 2/2011 | Carlitz | |
| 8,863,336 | B2 | 10/2014 | Theosabrata | |
| 8,984,690 | B2 | 3/2015 | Chunglo | |
| 9,211,017 | B2 | 12/2015 | Tyree | |
| 9,386,862 | B1 | 7/2016 | Limer | |
| 9,504,332 | B2 | 11/2016 | Gladney | |
| 2011/0173757 | A1* | 7/2011 | Rensink | A47C 27/15 5/698 |
| 2014/0033441 | A1* | 2/2014 | Morgan | A47C 21/044 5/724 |
| 2014/0255643 | A1 | 9/2014 | Koot et al. | |
| 2015/0342362 | A1 | 12/2015 | Thomas et al. | |

(Continued)

FOREIGN PATENT DOCUMENTS

| | | | | |
|---|---|---|---|---|
| CN | 2930463 Y | * | 8/2007 | A47C 31/006 |
| CN | 104665367 A | | 6/2015 | |

(Continued)

*Primary Examiner* — Nicholas F Polito
(74) *Attorney, Agent, or Firm* — Edell, Shapiro & Finnan LLC

(57) ABSTRACT

A mattress core includes sandwiched layer of coils that includes coils disposed between a first spacer fabric layer and a second spacer fabric layer. The mattress core also includes a viscoelastic foam disposed beneath the sandwiched layer of coils. A top surface of the first spacer fabric layer is disposed at or adjacent to a top surface of the mattress core. The first spacer fabric layer defines or more first air channels and the second spacer fabric layer defines one or more second air channels. The one or more first air channels extend above the coils included in the sandwiched layer of coils and the one or more second air channels extends below coils.

17 Claims, 6 Drawing Sheets

(56) References Cited

U.S. PATENT DOCUMENTS

| | | | | |
|---|---|---|---|---|
| 2016/0316927 | A1 | 11/2016 | Thomas et al. | |
| 2016/0367038 | A1 | 12/2016 | Gladney | |
| 2017/0035213 | A1 | 2/2017 | Limer | |
| 2019/0125092 | A1 * | 5/2019 | Ando | D04H 3/16 |

FOREIGN PATENT DOCUMENTS

| | | | | | |
|---|---|---|---|---|---|
| CN | 204635697 | U | * | 9/2015 | |
| CN | 104970620 | A | | 10/2015 | |
| CN | 208582052 | U | * | 3/2019 | |
| DE | 202014104492 | U1 | * | 9/2014 | F16B 39/023 |
| JP | 3790856 | B2 | * | 6/2006 | A47C 31/006 |
| JP | 2010184103 | A | * | 8/2010 | A47C 27/064 |

* cited by examiner

VENTILATED MATTRESS CORE

CROSS-REFERENCE TO RELATED APPLICATIONS

This application claims priority under 35 U.S.C. § 119(e) to U.S. Provisional Patent Application Ser. No. 62/544,055, entitled "Ventilated Mattress Core," filed Aug. 11, 2017, the disclosure of which is incorporated herein by reference in its entirety for all purposes.

FIELD OF THE INVENTION

The present invention is directed toward ventilated mattress core for bed mattresses and mattress toppers.

BACKGROUND

Mattresses and mattress toppers are often formed from a mattress core that is at least partially surrounded or encapsulated by a covering. The mattress core is typically formed from foam, such as polyurethane or latex foam, with or without coiled springs. Additionally or alternatively, mattress cores may be formed from viscoelastic foam (commonly referred to and referred to herein as memory foam), which is manufactured by introducing additives into a foam (i.e., a polyurethane foam) that increase the viscoelasticity of the foam. These materials (i.e., memory foam, foam, and/or coils) are often combined in different arrangements in efforts to provide comfortable mattresses and/or mattress toppers; however, these materials often prevent or discourage airflow that provides ventilation to a person resting or sleeping on the mattress. Memory foam, in particular, although widely perceived as comfortable (at least initially), may cause a person resting or sleeping on the mattress to become particularly warm since memory foam often provides minimal ventilation and may begin to extend around or envelop a person resting or sleeping thereon.

BRIEF SUMMARY

In accordance with example embodiments of the present invention, a mattress core for mattresses and mattress toppers includes a sandwiched layer of coils including coils disposed between a first spacer fabric layer and a second spacer fabric layer. The mattress core also includes a viscoelastic foam disposed beneath the sandwiched layer of coils. In at least some of these embodiments, a top surface of the mattress core is defined by a top surface of the first layer of the spacer fabric. Additionally or alternatively, the first layer of spacer fabric may define a first air channel and the second layer of spacer fabric may define a second air channel, the first air channel extending above the layer of coils and the second air channel extends below the layer of coils In accordance with some example embodiments, a mattress topper includes a first spacer fabric layer, a second spacer fabric layer, a layer of coils, a viscoelastic foam layer, and a cover. The second spacer fabric layer is disposed beneath the first spacer fabric layer and the layer of coils disposed between the first spacer fabric layer and the second spacer fabric layer. The viscoelastic foam layer disposed beneath the second spacer fabric layer. The cover is wrapped around the first spacer fabric layer, the second spacer fabric layer, the layer of coils, and the viscoelastic foam layer.

In accordance with yet other example embodiments, a mattress topper includes a first spacer fabric layer, a second spacer fabric layer, a layer of coils, a viscoelastic foam layer, a polyurethane foam support layer, and a cover. The second spacer fabric layer is disposed beneath the first spacer fabric layer and the layer of coils disposed between the first spacer fabric layer and the second spacer fabric layer. The viscoelastic foam layer disposed beneath the second spacer fabric layer and the polyurethane foam support layer disposed beneath the viscoelastic foam. The is wrapped around the first spacer fabric layer, the second spacer fabric layer, the layer of coils, the viscoelastic foam layer, and the polyurethane foam support.

BRIEF DESCRIPTION OF THE DRAWINGS

Like numerals identify like components throughout the figures.

DETAILED DESCRIPTION

Figure 1:
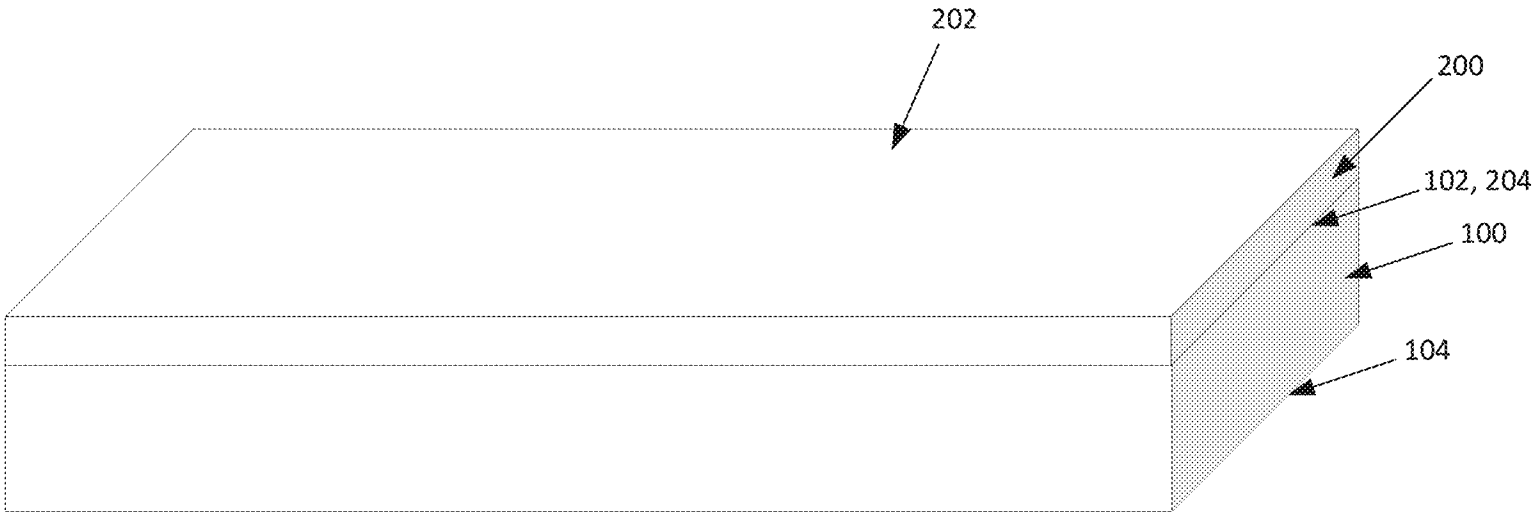
FIG. 1 is a perspective view of a mattress and a mattress topper that each include a mattress core formed in accordance with embodiments of the invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C). Additionally, the phrase "at least one of A and B" means that A is present, Be is present, or both A and B are present.

The terms "comprising," "including," "having," and the like, as used with respect to embodiments of the present disclosure, are synonymous.

Now referring generally to the Figures, a mattress core for bed mattresses and mattress toppers, as well as a method of forming the mattress core, are presented herein. Generally, the mattress core includes a layer of coils that is positioned, or sandwiched, between two spacer fabrics, the lowermost of which is positioned atop of a viscoelastic foam layer (a memory foam layer). That is, a viscoelastic foam layer underlays the sandwiched layer of coils and supports a spacer fabric disposed beneath the layer of coils. The spacer fabric between the viscoelastic foam and the layer of coils allows air to easily flow between the viscoelastic foam and the layer of coils. Consequently, among other advantages, the mattress core provides improved airflow that effectively dissipates any heat emanating from a person sleeping or resting on a mattress including the mattress core while still providing the comfortable feel of memory foam. This provides improved comfort for a person sleeping atop a mattress and/or mattress toppers.

Still referring generally to the Figures, the viscoelastic foam layer may, in at least some embodiments of the mattress core, be positioned atop and supported by any number of additional components and/or layers of material (wherein "additional" implies the components and/or layers are provided in addition to the layer of coils and the two spacer fabrics), such as one or more layers of polyurethane foam. That is, additional layers or components may underlay the viscoelastic foam layer. Additionally or alternatively, additional layers or components may overlay (i.e., be positioned above) the sandwiched layer of coils. In still other embodiments, the mattress core may be formed with only the viscoelastic foam and the sandwiched layer of coils. Regardless, once the mattress core is formed, the mattress core may be wrapped in, encapsulated in, inserted into, or otherwise covered with a covering, such as a fire resistant sock and ticking that encloses the components of the mattress core and provides a safe, sturdy, and comfortable mattress or mattress topper.

Now turning to FIG. 1, a mattress 100 is shown with a mattress topper 200 disposed thereon. In actuality, the mattress 100 and mattress topper 200 may not need to be used together; however, the mattress 100 and mattress topper 200 are illustrated together to illustrate two possible embodiments of the mattress core presented herein. Moreover, in the depicted embodiment, the mattress 100 and mattress topper are illustrated as a square or nearly square mattress (i.e., like a standard 76 inch by 80 inch king size mattress), but in different embodiments, the mattress core may be sized as a traditional twin (38 inches wide by 75 inches long (38"×75")), a traditional twin extra-long (38"×80"), a traditional full (54"×75"), a traditional queen (60"×80"), a traditional king (76"×80"), a traditional California king (72"×84"), or any custom or non-standard size constructions.

Regardless of their length and width, the mattress 100 has a top 102 and a bottom 104 while the mattress topper 200 has a top 202 and a bottom 204. In the depicted embodiment, top 102 and top 202 are configured to consistently be the top of the mattress 100 and mattress topper 200, respectively, so that the air channels created by spacer fabrics included in the mattress core are disposed adjacent a person sleeping on the mattress (as is described in further detail below in connection with FIGS. 2 and 3). However, in other embodiments, the mattress 100 could be configured as a two-sided mattress by duplicating the sandwiched coil layer and including a sandwiched coil layer adjacent the top 102 and the bottom 104 of the mattress 100. Similarly, the mattress topper 200 could be configured as two-sided mattress topper by duplicating the sandwiched coil layer and including a sandwiched coil layer adjacent the top 202 and the bottom 204 of the mattress topper 200.

Figure 2:
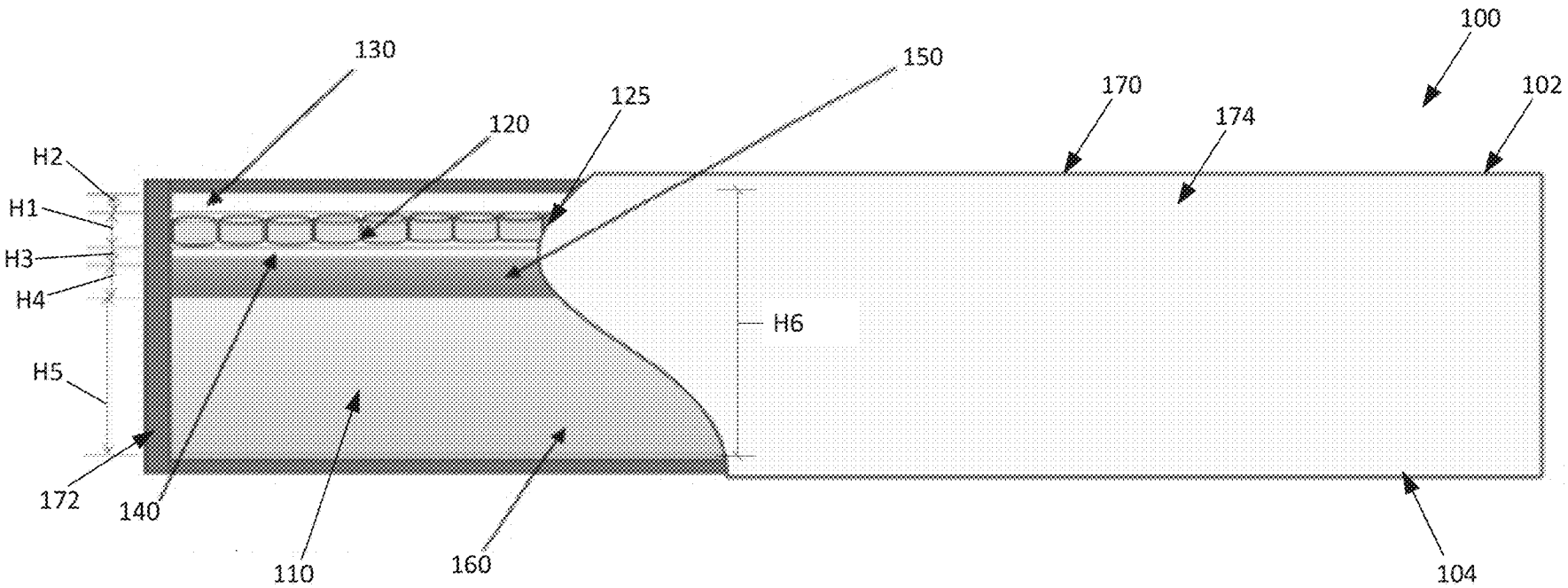
FIG. 2 is a sectional view of the mattress of FIG. 1, showing the mattress core included therein.
Figure 3:
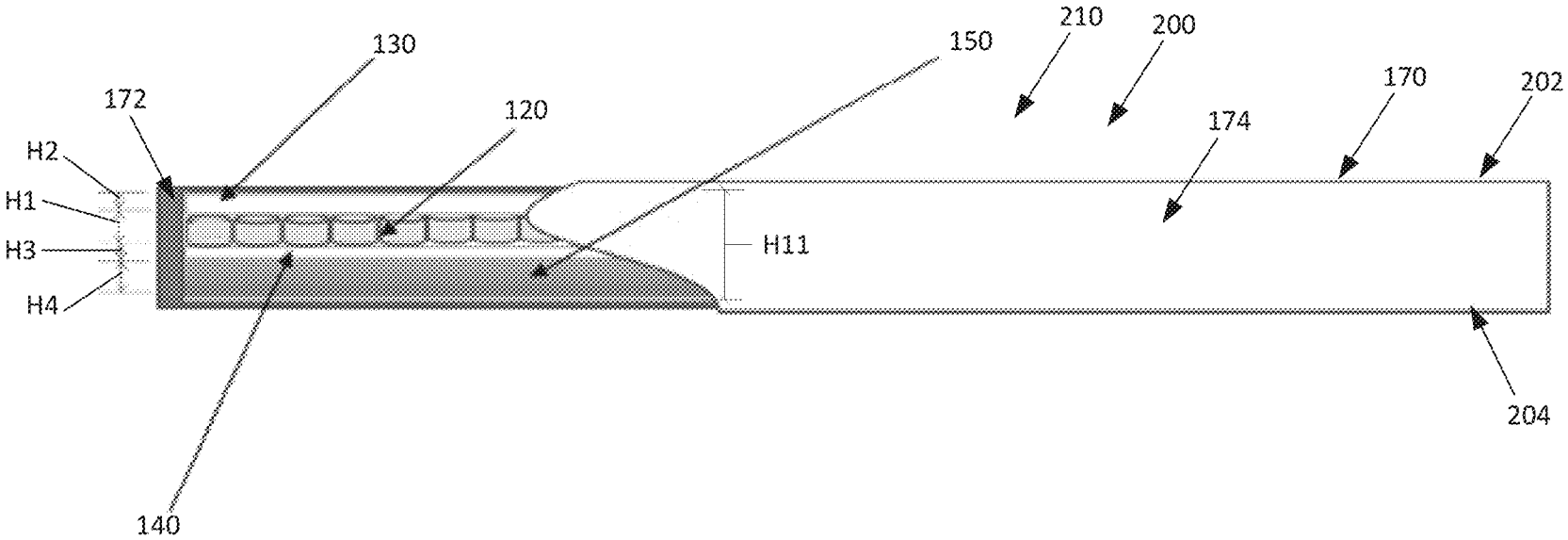
FIG. 3 is a sectional view of the mattress topper of FIG. 1, showing the mattress core included therein.

Now referring to FIGS. 2 and 3 for a description of two example embodiments of a mattress core that provides enhanced airflow. FIG. 2 depicts a cross sectional view of mattress 100 that illustrates a mattress core 110. Similarly, FIG. 3 depicts a cross sectional view of mattress topper 200 that illustrates a mattress core 210. These two embodiments are similar in many aspects and, in particular, include similar components. Consequently, the components included in core 110 are now described with regards to core 110 and core 210 and the specific cores 110 and 210 are each described individually in further detail thereafter.

Initially, core 110 and core 210 each include a layer of coils 120 that is sandwiched between a first layer of spacer fabric 130 and a second layer of spacer fabric 140. The first layer of spacer fabric 130 is disposed above (i.e., overlays) the layer of coils 120 and the second layer of spacer fabric 140 is disposed beneath (i.e., underlays) the layer of coils 120 along the entire length and width of the core 110 or core 210. Consequently, the layer of coils 120 is only in contact with the first layer of spacer fabric 130 and the second layer of spacer fabric 140, except along its edges, which may contact a cover 170 that is wrapped around the core 110 or core 210. For simplicity, the coils 120, spacer fabric 130, and spacer fabric 140 may be collectively referred to as a sandwiched coil layer 125.

The coils in the layer of coils 120 may be coils of any shape or type. For example, the coils may be symmetrical, single stranded, pocketed (i.e., encased) coil springs, asymmetrical, multi-stranded, unpocketed coil springs, or any variation thereof. The coils may also be formed from any desirable material or materials, including steel, aluminum, plastic, copper, etc. (and any pockets may be formed from any suitable fabric materials). Moreover, the coils may be attached together in any manner to form the layer of coil springs 120 that extends across the entire length and width of core 110 or core 210, in any arrangement, alignment, or configuration (i.e., an array of columns and rows or a honeycomb alignment). As one specific example, the layer of coils 120 may be a layer of POSTURFIL pocketed coil springs manufactured by SPINKS SPRINGS. Regardless, the layer of coils 120 is overlaid and underlaid with spacer fabrics that extends across the top and bottom surfaces of the layer of coils 120.

The spacer fabrics 130 and 140 are any highly breathable fabrics that enable air to pass therethrough. That is, as used herein, a spacer fabric is a fabric that provides one or more air channels therein. For example, a spacer fabric may be a pile fabric without cuts, such as a pile fabric formed by joining two distinct fabrics with microfilament yarn to create a breathable channel between the two distinct fabrics (with the two distinct fabrics defining a top and bottom of the spacer fabric). Due to their construction, spacer fabrics may generally have a three dimensional appearance.

Figure 6:
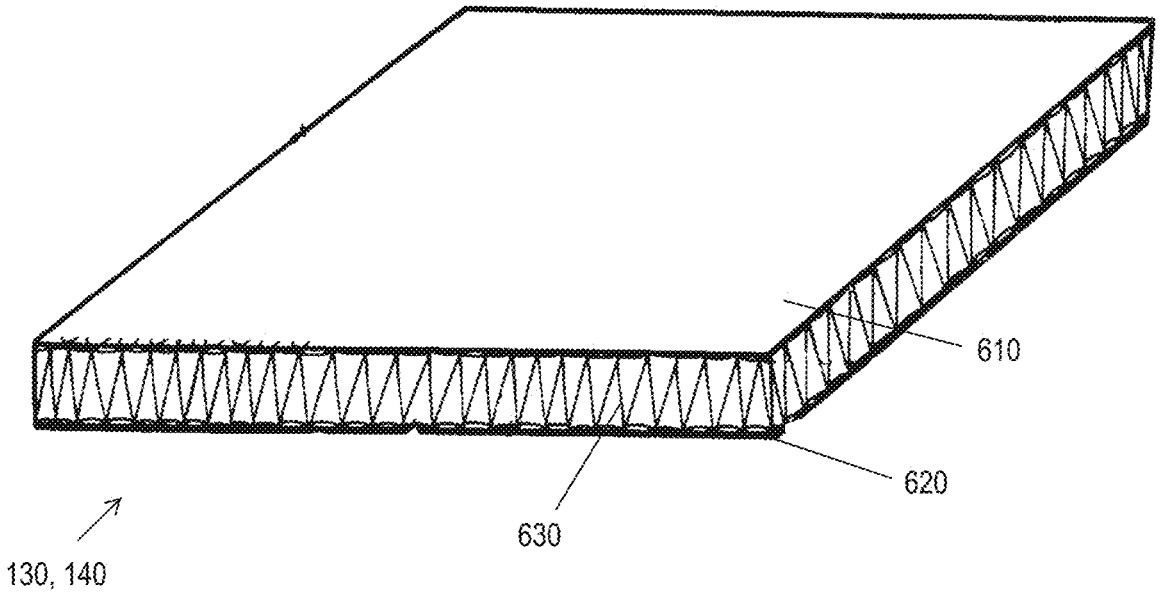
FIG. 6 illustrates a schematic of a spacer fabric construction in accordance with an embodiment.

More specifically, spacer fabrics 130 and 140 are each a three-dimensional textile that facilitates airflow, breathability and lightweight shape support. Referring to FIG. 6, the spacer fabric 130, 140 includes a first layer or substrate 610 (e.g., outer, upper, or user-facing layer) and a second layer or substrate 620 (e.g., an inner, lower or foam/coil facing layer) that is substantially coextensive with the first layer and connected thereto by crossing or spacing strands 630. The crossing strands 630 may be organized in an array, forming rows of spaced crossing strands. The rows may be substantially parallel to each other and distributed at substantially equal distances across spacer textile material. Alternatively, the crossing strands could be non-parallel and/or unevenly spaced apart. The density (yarn count) of crossing strands 630 is not limited and may be selected to provide a desired level of mechanical properties (e.g., compression resistance) and/or thermal properties (e.g., airflow).

The spacer fabric 130, 140 may be formed by any suitable method. By way of example, the spacer fabric may be formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops. In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the strands/loops alternating back and forth across the fabric.

Accordingly, by way of specific example, the spacer fabric 130, 140 includes an upper knit fabric layer 610 and a lower knit fabric layer 620 oriented parallel to the upper knit fabric layer 610 and spaced from the upper layer 610 by a space or gap. The crossing strands 630 span the gap, extending from an interior surface of the outer layer 610 to an interior surface of the inner layer 320.

The strands forming the knitted textile (and thus the spacer fabric 130, 140) may be any natural or synthetic strands suitable for their described purpose. The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament). A combination of the above may be utilized. By way of example, the crossing strands 630 of spacer fabric 130, 140 may be monofilaments, while the strands forming the inner and outer layers 610, 620 are multifilament strands.

The strands may be elastic strands or inelastic strands. Elastic strands are strands formed of elastomeric material. Elastic strands, by virtue of their composition alone, are capable of stretching under stress and recovery to its original size once the stress is released. Accordingly, elastic strands are utilized to provide a textile with stretch properties. An elastic strand is formed rubber or a synthetic polymer having properties of rubber. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

In contrast, an inelastic strands are formed of a non-elastomeric material. Accordingly, inelastic strands possess no inherent stretch and/or recovery properties by virtue of composition. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

In an embodiment, the spacer fabric 130, 140 includes an inelastic strand possessing a topology that enables it to provide mechanical stretch and recovery within the knit structure. In an embodiment, the inelastic strand is a hard yarn texturized to generate stretch within the yarn. In a preferred embodiment, the inelastic strand is a bicomponent strand formed of two polymer components, each component possessing differing properties. The components may be organized in a sheath-core structure. Alternatively, the components—also called segments—may be oriented in a side-by-side (bilateral) relationship, being connected along the length of the strand.

By way of example, the strand is a polyester bicomponent strand. A polyester bicomponent strand is a continuous filament having a pair of polyesters connected side-by-side, along the length of the filament. Specifically, the polyester bicomponent strand may include a poly(trimethylene terephthalate) and at least one polymer selected from the group consisting of poly(ethylene terephthalate), poly(trimethylene terephthalate), and poly(tetramethylene terephthalate) or a combination thereof. By way of example, the polyester bicomponent filaments include poly(ethylene terephthalate) and poly(trimethylene terephthalate) in a weight ratio of about 30/70 to about 70/30. In a preferred embodiment, the first polyester component is a 2GT type polyester polyethylene terephthalate (PET) and the second polyester component is a 3GT type polyester (e.g., polytrimethylene terephthalate (PTT)). In an embodiment, the 2GT type polyester forms about 60 wt % of the strand, while the 3GT type polyester forms about 40 wt % of the strand. As noted above, the strand may be in the form of, without limitation, a single filament or a collection of filaments twisted into a yarn.

With the above configuration, when exposed to heat, the first polymer (polyester) segment shrink/contracts at a different rate than the second polymer (polyester) segment. This, in turn, produces a regular, helical coil along the length of the strand. In an embodiment, the contraction value of each polymer segment may range from about 10% to about 80% (from its original diameter). The strand may possess an after-heat-set crimp contraction value from about 30% to about 60%. The helical coil of the strand generates non-elastomeric, mechanical stretch and recovery properties within the strand (e.g., the filament or yarn). That is, the strand possesses mechanical stretch and recovery without the need to texturize the strand, which reduces strand durability. A bicomponent strand, moreover, possesses increased recovery properties compared to elastic strands at stretch levels of less than 25%. The recovery power of elastic strands increases with increasing stretch (e.g., 100% or more). Stated another way, the further an elastic strand is stretched, the better it recovers.

In addition to providing stretch and recovery properties to the spacer fabric, placing bicomponent strands within the fabric assist in modulating the temperature along the user by forming an uneven or undulating surface. Similarly, bicomponent strands possess different degrees of loft, with the effect strand possessing greater loft than the base strand. As a result, the bicomponent strands may protrude from the surface of the fabric. Accordingly, the only contact points of the spacer fabric are the protruding, bicomponent strands. Spacing the garment away from the user (e.g., spacing approximately 2 mm) encourages airflow, increasing wearer comfort. When the bicomponent strands are polyester bicomponent strands, moreover, the spacer fabric possesses a low water retention property. That is, any moisture from the wearer (e.g., sweat) contacts the polyester bicomponent strands, which draws the moisture through the strand and disperses the moisture along the fabric. Since wet fibers are not in continuous contact with user, the comfort level of the article of apparel is improved.

In an embodiment, the knit structure of the spacer fabric first, high thermal conductivity strands and second, low thermal conductivity strands. High conductivity strands are strands that transfer heat along its length (axis) and/or width (transverse dimension) at a higher rate than low thermal conductivity strands. In an embodiment, high thermal conductivity strands are strands formed (e.g., entirely formed) of material possessing a thermal conductivity value greater than 0.40 W/m K. By way of example, the strands may be formed of high density polyethylene (HDPE, 0.45-0.52 @23 C) and/or ultra-high molecular weight polyethylene (UWMW-PE, 0.42-0.51 W/m K @23 C).

In a further embodiment, high thermal conductivity strand is a strand that possessing an axial thermal conductivity of at least 5 W/m K (e.g., at least 10 W/m K or at least 20 W/m K). The high thermal conductivity strand may be a multifilament fiber such as a gel-spun fiber. By way of specific example, the high conductivity strand is a gel-spun, multifilament fiber produced from ultra-high molecular weight polyethylene (UHMW-PE), which possesses a thermal conductivity value in the axial direction of 20 W/m K (DYNEEMA, available from DSM Dyneema, Stanley, N.C.).

The low thermal conductivity strand, in contrast, transfers heat along its length (axis) and/or width (transverse dimension) at a lower rate than that of the high thermal conductivity strand. In an embodiment, the low thermal conductivity strand is formed (e.g., entirely formed) of material possessing a thermal conductivity of no more than 0.40 W/m K. By way of example, the low conductivity strand may be formed of low density polyethylene (LDPE, 0.33 W/m K @23 C), nylon (e.g., nylon 6; nylon 6,6; or nylon 12) (0.23-0.28 W/m K @23° C.), polyester (0.15-0.24 W/m K @23° C.), and/or polypropylene (0.1-0.22 W/m K @23 C).

In another embodiment, the low thermal conductivity strand possesses an axial thermal conductivity (as measured along its axis) that is less than the axial conductivity of the high conductivity strands. By way of example, the low thermal conductivity strands possess an axial thermal conductivity value of less than 5 W/m K when high thermal conductivity strand possesses a thermal conductivity of greater than 5 W/m K; of less than 10 W/m K when high conductivity strand possesses a thermal conductivity of at least 10 W/m K; and/or less than 20 W/m K when high conductivity strand possesses a thermal conductivity of greater than 20 W/m K. Exemplary low thermal conductivity strands include strands formed of polyester staple fibers (axial thermal conductivity: 1.18 W/m K); polyester filament strands (axial thermal conductivity: 1.26 W/m K); nylon fiber strands (axial thermal conductivity: 1.43 W/m K); polypropylene fiber strands (axial thermal conductivity: 1.24 W/m K); cotton strands (axial thermal conductivity: 2.88 W/m K); wool strands (axial thermal conductivity: 0.48 W/m K); silk strands (axial thermal conductivity: 1.49 W/m K); rayon strands (axial thermal conductivity: 1.41-1.89 W/m K); and aramid strands (axial thermal conductivity: 3.05-4.74 W/m K), as well as combinations thereof.

The strands may be heat sensitive strands such as flowable (fusible) strands and softening strands. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions but become irreversibly inflexible upon heating.

The strands may also include heat insensitive strands. Heat insensitive strands are not sensitive to the processing temperatures experienced by the mattress (e.g., during formation and/or use). Accordingly, heat insensitive strands possess a softening, glass transition, or melting point value greater than that of any softening or melting strands present in the textile structure and/or greater than the temperature ranges specified above.

With this configuration, thermal properties (moisture removal, heat dissipation, and/or airflow) along the user are improved. That is, the space or gap formed by the crossing strand is present exhibits air permeability higher than that of the conventional knit or a foam layer.

In an embodiment, the first layer 610 and the second layer 630 may be joined such that one or more channels for are formed into the spacer fabric 130, 140. By way of example seams (stitching or embroidery) may be utilized. By way for further example, welding may be utilized. The welding method utilized to join the first layer to the second layer may include a high frequency welding method such as ultrasonic welding or radio frequency welding. Ultrasonic welding devices utilize high frequency ultrasonic acoustic vibrations. The vibrations cause friction capable of softening the spacer textile material, fusing the first layer to the second layer. Positioning discrete, parallel, spaced seams or welds along the spacer fabric 130, 140 creates a series of channels or baffles capable of directing airflow along the fabric.

Still referring to FIGS. 2 and 3, the sandwiched coil layer 125 is positioned atop (i.e., overlays) a viscoelastic foam 150. The viscoelastic foam 150, which is commonly referred to as memory foam, has an open-celled structure that can mold around a load acting on the viscoelastic foam 150, for example, to mold around a person's body, but is also quite resilient so that the memory foam 150 can return to its rest or original position when a load is removed from the memory foam 150. In different embodiments, different versions or constructions of memory foam 150 may be included in core 110 or core 210. For example, the foam 150 can be selected from memory foams with cell structures that are extremely tight (i.e., nearly closed), memory foams with very open (and, thus, more breathable) cell structures, or any other cell structures.

In some embodiments, the mattress cores 110 and 210 may also include additional layers, such as additional foam layers, batting, waterproof liners, etc. As one example, mattress core 110 includes a foam support component 160. In the depicted embodiment, the foam support component 160 is a polyurethane foam; however, in other embodiments, the foam support component 160 may be a latex foam, a polypropylene foam, or a foam formed from a combination of any suitable materials, including natural and synthetic materials. For simplicity and also for clarity with respect to the viscoelastic foam 150, the foam support component 160 may sometimes be referred to as a non-viscoelastic foam.

As is described in further detail in connection with FIGS. 4 and 5, generally, the various layers or components of mattress core 110 and mattress core 210 can be assembled with any mattress assembly techniques now know or developed hereafter. For example, the various components may be coupled together along any abutting surfaces (i.e., the top surface of the viscoelastic foam 150 may be coupled to the bottom surface of the sandwiched coil layer 125) with mechanically couplings, thermal bonding techniques, etc. The couplings may be provided at select locations along abutting surfaces or along the entirety of abutting surfaces. In addition to or in lieu of coupling the various components together, the various components of mattress core 110 and mattress core 210 can be wrapped with a cover 170. In the embodiments depicted in FIGS. 2 and 3, the cover 170 includes a fire resistant sock 172 and ticking 174.

Now referring specifically to FIG. 2, the various components of the mattress core 110 can have various dimensions to provide a mattress 100 of a desired thickness. However, generally, the overall height of mattress core 110 can be adjusted by adjusting the height of the foam support component 160. By comparison, generally, the height of the components in the sandwiched layer 125 (i.e., coils 120, first spacer fabric 130, and second spacer fabric 140) and/or the viscoelastic foam 150 can be adjusted to provide varied or customized amounts of cooling and/or comfort (i.e., to provide a mattress core 110 that is "harder" (i.e., "firmer") or "softer" (i.e., more cushioned), as well as more breathable or less breathable).

In one example embodiment, the sandwiched layer 125 has an overall height in the range of approximately 1.5 inches to approximately 3 inches, with the coils 120 having a height H1 in the range of approximately 0.75 inches to approximately 1.25 inches, the first spacer fabric layer 130 having a height H2 in the range of approximately 0.5 inches to approximately 1 inch, and the second spacer fabric layer 140 having a height H3 in the range of approximately 0.25 inches to approximately 0.75 inches. The second spacer fabric 140 is often thinner than the first spacer fabric 130 (i.e., has a shorter height, such that H3 is smaller than H2) and, thus, one or more first air channels provided by the first spacer fabric 130 may collectively provide a first cross-sectional area for airflow that is larger than a second cross-sectional area for airflow collectively provided by the one or more second air channels provided by the second spacer fabric 140.

Moreover, in at least some embodiments, the height H2 of the first spacer fabric 130 may be based on the height H3 of the second spacer fabric 140, or vice versa, and. For example, if H2 is on a shorter end of its range, H3 may also be on a shorter end of its range (i.e., if H2 is 0.5 inches, H3 may be 0.25 inches). Thus, a size of one or more first air channels provided by the first spacer fabric 130 may be proportional to a size of the one or more second air channels provided by the second spacer fabric 140. This may maximize that amount of air flowing or passing through the core 110 adjacent to a person sleeping or resting atop of the mattress 100 (e.g., through channels in spacer fabric layer 130) while still providing air channels on either side of the coil springs (as opposed to introducing more air into the air channel adjacent the memory foam 150, which may dissipate into the memory foam 150 instead of a person resting thereon).

Meanwhile, in this example embodiment, the viscoelastic foam layer 150 has a height H4 in the range of approximately 1.75 inches to approximately 2.25 inches and the polyurethane foam 160 may have a height H5 in the range of approximately 9.25 inches to approximately 9.75 inches. Consequently, the mattress core 110 may have an overall height H6 in the range of approximately 12.5 inches to approximately 15 inches.

As some more specific examples, a mattress core 110 having an overall thickness H6 of 13.75 inches may include, in sequence from top to bottom: a 0.75 inch layer of spacer fabric 130, a 1 inch layer of coils 120, a 0.5 inch layer of spacer fabric 140, a 2 inch layer of memory foam 150, and a 9.5 inch layer of polyurethane foam 160. By comparison, a mattress core 110 having an overall thickness H6 of 11.75 inches might include, in sequence from top to bottom: a 0.75 inch layer of spacer fabric 130, a 1 inch layer of coils 120, a 0.5 inch layer of spacer fabric 140, a 2 inch layer of memory foam 150, and a 7.5 inch layer of polyurethane foam 160. Still further, a firmer a mattress core 110 having an overall thickness H6 of 11.75 might include, in sequence from top to bottom: a 0.75 inch layer of spacer fabric 130, a 1 inch layer of coils 120, a 0.5 inch layer of spacer fabric 140, a 1.5 inch layer of memory foam 150, and a 8 inch layer of polyurethane foam 160 (notably, the memory foam 150 is thinner than the previous example and the polyurethane foam 160 is thicker). If instead, the breathability of the mattress core needs to be adjusted, the thickness of spacer fabric layers 130 and 140 can be adjusted (with thicker spacer fabric layers offering more breathability or ventilation).

By comparison, the mattress core 210 of the mattress topper 200 depicted in FIG. 3 does not include a foam support component 160 and, thus, the memory foam 150 may be the main driver of the overall height H11 of the mattress topper core 210. That being said, the components that are included in the mattress topper (i.e., the coil layer 120, the first spacer fabric 130, the second spacer fabric 140, and the memory foam 150) may be substantially similar or identical to like components of the mattress core 100 and, thus, any description of these components included above is to be understood to apply to the components of the mattress topper core 210. For example, in one embodiment, the sandwiched layer 125 and viscoelastic foam 150 have the dimensions described above (i.e., the sandwiched layer 125 has an overall height (which is the sum of H1, H2, and H3) in the range of approximately 1.5 inches to approximately 3 inches and the viscoelastic foam layer has a height H4 in the range of approximately 1.75 inches to approximately 2.25 inches). Consequently, the mattress core 210 of the mattress topper 200 may have an overall height H11 in the range of approximately 3.25 inches to approximately 5.25 inches.

As some more specific examples, a mattress core 210 having an overall thickness H11 of 4.25 inches may include, in sequence from top to bottom: a 0.75 inch layer of spacer fabric 130, a 1 inch layer of coils 120, a 0.5 inch layer of spacer fabric 140, and a 2 inch layer of memory foam 150. By comparison, a mattress core 210 having an overall thickness H11 of 3.75 inches might include, in sequence from top to bottom: a 0.75 inch layer of spacer fabric 130, a 1 inch layer of coils 120, a 0.5 inch layer of spacer fabric 140, and a 1.5 inch layer of memory foam 150. As mentioned above, thinning the memory foam may make the mattress core 210 slightly firmer (or "less soft"). If instead, the breathability of the mattress core is adjusted, the thickness of the spacer fabric layers can be adjusted (with wider spacer fabric layers offering more breathability or ventilation). For example, a mattress core 210 that is "more breathable" than the prior two example may have an overall thickness H11 of 4.75 inches including, in sequence from top to bottom: a 1 inch layer of spacer fabric 130, a 1 inch layer of coils 120, a 0.75 inch layer of spacer fabric 140, and a 2 inch layer of memory foam 150.

As noted above, the various combinations of layers or components may be coupled together in any manner (i.e., with adhesive, fasteners, thermal bonding techniques, etc.) and/or may be encased within a covering 170. Encasing mattress core 110 or mattress 210 may involve wrapping a fireproof sock 172 and/or ticking 174 entirely around a core so that the fireproof sock 172 and/or ticking 174 covers a top, bottom, and perimeter of mattress core 110 or mattress 210. Alternatively, covering 170 may only be wrapped around the perimeter of a mattress core presented herein so that a top surface of the first spacer fabric 130 and a bottom surface of the foam support component 160 or memory foam 150 remain exposed after the core is encased.

As more specific examples, for the mattress core 110, fireproof sock 172 and/or ticking 174 may cover a top surface of the first spacer fabric 130, a bottom surface of the foam support component 160 and the peripheral edges of each component included in core 110 (i.e., the coil layer 120, the first spacer fabric 130, the second spacer fabric 140, the memory foam 150, and the foam support component 160). By comparison, for the mattress core 210, fireproof sock 172 and/or ticking 174 may cover a top surface of the first spacer fabric 130, a bottom surface of the memory foam 150 and the peripheral edges of each component included in core 210 (i.e., the coil layer 120, the first spacer fabric 130, the second spacer fabric 140, and the memory foam 150). In some embodiments, core 110 and core 210 are first encased (i.e., wrapped) with fireproof sock 172 and subsequently wrapped with ticking 174. However, in other embodiments, core 110 and core 210 are first encased (i.e., wrapped) with ticking 174 and subsequently wrapped with fireproof sock 172.

Bioceramic materials can be incorporated into any portion of any of the mattress components (e.g., spacer fabric 130, 140; ticking 174; etc.) in any suitable manner such as described herein. Bioceramic materials that are suitable for use in the bedding components to achieve the desired effect include ceramic oxide materials and non-oxide ceramic materials including, without limitation, silicon oxides (e.g., $SiO_2$), zirconium oxides (e.g., $ZrO_2$), titanium oxides (e.g., $TiO_2$), aluminum oxides (e.g., $Al_2O_3$), magnesium oxides (e.g., MgO), yttrium oxide ($Y_2O_3$), zirconium carbide (ZrC), titanium carbide (TiC), etc.

The bioceramic materials can be incorporated or integrated onto or into a surface of a bedding component as a powder or other substance that is printed or applied in any other manner to the surface so as to form one or more layers of the bioceramic material on the surface. For example, as described herein, a bioceramic powder, such as a $SiO_2$ (or any of the other ceramic material listed herein) can be printed onto the sleep recovery surface of a mattress component. A bioceramic component can also be incorporated or integrated within a filament or fiber which is then incorporated in some manner within the bedding component (e.g., integrated as part of a yarn material used to form a bedding component, or provided within a mat of material within the mattress component). Some examples of bioceramic fibers, filaments or yarns that can be integrated within bedding components of the bedding system include, without limitation: a polyethylene terephthalate (PET) fiber including one or more bioceramic particles (e.g., silicon oxide and/or aluminum oxide) embedded in the core of the fiber, such as fibers commercially available under the trade name Celliant (Hologenix, LLC, California); a polyamide (e.g., nylon 6,6) yarn incorporated with bioceramic particles, such as a bioceramic yarn commercially available under the trademark Emana® (Solvay Group, Belgium); and a combination of cotton and bioceramic yarn, such as is commercially available from Samina (Germany).

A bioceramic material can be applied as a layer to a surface of a mattress component in any suitable manner. In an example embodiment, the bioceramic material is printed on the surface of a bedding component. The bioceramic material can be provided in powder form or in a liquid form, such as an ink, for printing onto the bedding component surface. In an ink form, the amount of bioceramic material within the ink can range from about 2% by weight to about 50% or greater by weight. For example, the amount of bioceramic material within the bioceramic ink can be in an amount of at least about 2% by weight, at least about 5% by weight, at least about 25% by weight, at least about 30% by weight, at least about 40% by weight, or no greater than about 50% by weight. In another example, the amount of bioceramic material within the bioceramic ink can be in an amount of about 5% by weight to about 15% by weight, or from about 8% by weight to about 12% by weight (e.g., about 10% by weight).

The bioceramic materials are ceramic materials that have certain beneficial properties for human body wellness and recovery, including the reflection and/or emission of IR light based upon thermal energy generated by the user (e.g., during sleep). By placing bioceramic materials in bedding components, such as along user-facing and/or sleep recovery surfaces of bedding components and/or within certain bedding components (e.g., within the spacer fabric 130 and/or spacer fabric 140), the bioceramic materials can emit and/or reflect IR light toward the user to enhance body recovery (e.g., by increasing blood flow and oxygen levels in the user's body, enhancing/speeding up recovery time for a user after engaging in intense physical activity, and stimulating other metabolic processes of the user).

Figure 4:
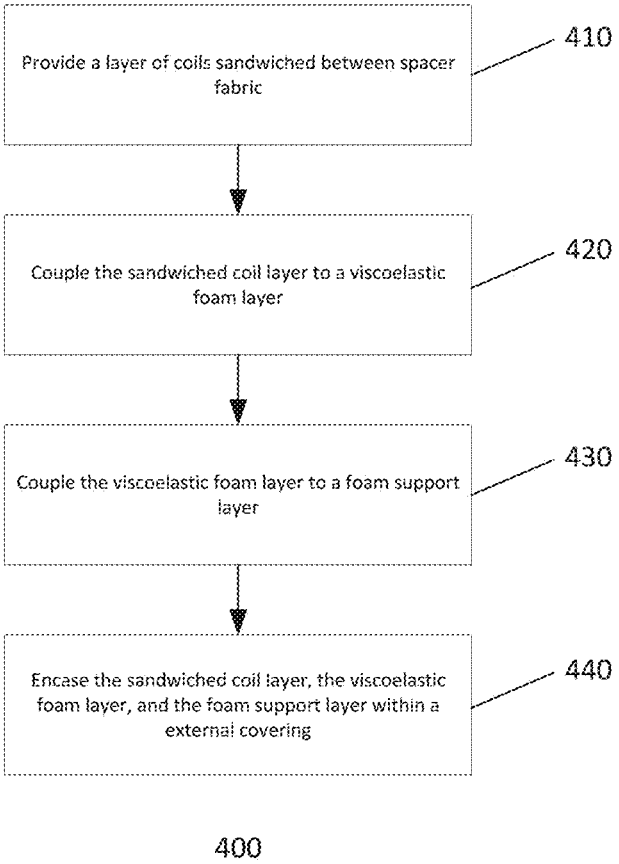
FIG. 4 is a flow chart illustrating a method of forming the mattress of FIG. 1.

FIG. 4 illustrates a flow chart 400 of a method of providing the mattress core 110 shown and described herein. At 410, a layer of coils sandwiched between spacer fabrics is provided. For example, spacer fabrics may be coupled to or positioned abutting a top and bottom surface of a layer of coils to form a sandwiched layer of coils, such as sandwiched layer 125. At 420, the sandwiched layer is coupled to a viscoelastic foam layer, such as memory foam 150. That is, the sandwiched layer of coils is coupled to a first surface of the viscoelastic foam. At 430, the viscoelastic foam layer is coupled a foam support layer. More specifically, a foam support layer is coupled to the viscoelastic foam layer at a bottom side of the viscoelastic foam (i.e., at an opposite side from the side at which the viscoelastic foam is coupled to the sandwiched layer of coils). At 440, the sandwiched coil layer, the viscoelastic foam layer, and the foam support layer are encased within an external covering.

Figure 5:
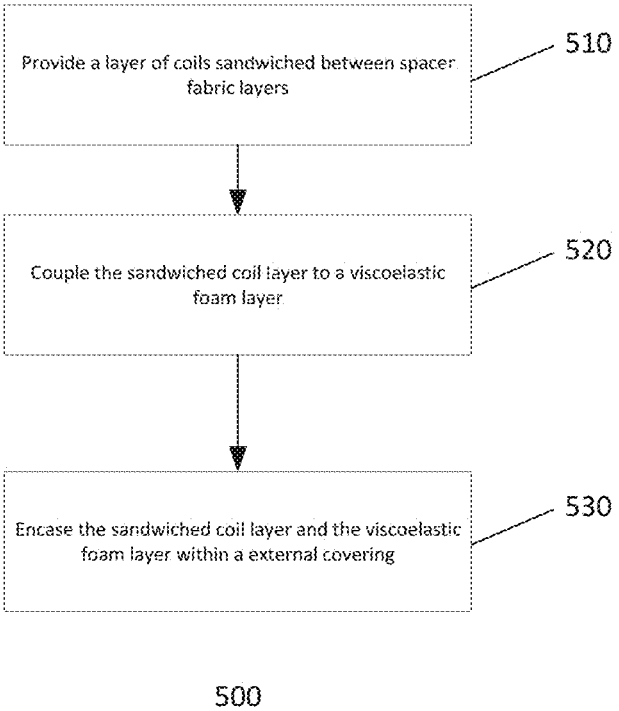
FIG. 5 is a flow chart illustrating a method of forming the mattress topper of FIG. 1.

FIG. 5 illustrates a flow chart 500 of a method of providing the mattress core 210 shown and described herein. At 510, a layer of coils sandwiched is provided between spacer fabrics, similar to operation 410. At 520, the sandwiched layer is coupled to a viscoelastic foam layer, such as memory foam 150, similar to operation 420. That is, the sandwiched layer of coils is coupled to a first surface of the viscoelastic foam. At 530, the sandwiched coil layer and the viscoelastic foam layer are encased within an external covering, similar to operation 440.

Generally, each of the operations depicted in FIGS. 4 and 5 can be performed in accordance with the techniques described above in connection with FIGS. 1-3. For example, various layers or components can be coupled together with adhesion, thermal bonding, fasteners, etc., along an entirety of abutting surfaces of at select locations along abutting surfaces. Moreover, in different embodiments, the operations depicted in FIGS. 4 and 5 need not be performed in the depicted order. For example, the viscoelastic foam may be coupled to a spacer fabric before the spacer fabric is sandwiched around a coil layer and/or the viscoelastic foam may be coupled to a foam support layer before any other operations are performed.

With the configuration described above, a mattress core is provided that is not only comfortable but breathable. This keeps a person cool and comfortable while the person is resting or sleeping atop of a mattress or mattress topper including the mattress core. Since people often wake up or become restless when their body overheats during sleep, this is quite advantageous and will allow users to get more restful sleep.

While the invention has been described in detail and with reference to specific embodiments thereof, it will be apparent to one skilled in the art that various changes and modifications can be made therein without departing from the spirit and scope thereof. For example, the mattress core may also include additional layers or components (i.e., at or near the bottom of the mattress core) in order to improve the stability or durability of the mattress core. Additionally or alternatively, the mattress core could be wrapped or encased in a structure or component that enhances airflow into the spacer fabrics.

It is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration.

Thus, it is intended that the present invention covers the modifications and variations of this invention provided they come within the scope of the appended claims and their equivalent.

What is claimed is:

1. A mattress core comprising:

a sandwiched layer of coils consisting of pocketed or unpocketed coils disposed between and abutting both a first spacer fabric layer extending above the coils to define a top surface of the mattress core and a second spacer fabric layer extending below the coils, wherein:

the first spacer fabric layer defines one or more first air channels that collectively provide a first cross-sectional area for airflow, the second spacer fabric layer defines one or more second air channels that collectively provide a second cross-sectional area for airflow, and the first cross-sectional area having a first height that is larger than a second height of the second cross-sectional area; and a viscoelastic foam disposed beneath the sandwiched layer of coils.

2. The mattress core of claim 1, wherein a size of one or more first air channels is proportional to a size of the one or more second air channels.

3. The mattress core of claim 1, further comprising:

a foam support disposed beneath the viscoelastic foam.

4. The mattress core of claim 3, wherein the mattress core includes a periphery and the viscoelastic foam extends to the periphery such that the viscoelastic foam extends between a bottom surface of the sandwiched layer of coils and a top surface of the foam support.

5. The mattress core of claim 3, wherein the foam support comprises polyurethane foam, a latex foam, and/or a polypropylene foam.

6. The mattress core of claim 1, wherein the mattress core further comprises:

a cover that encircles at least a portion of the mattress core.

7. The mattress core of claim 6, wherein the first spacer fabric layer defines a top surface of the mattress core, the viscoelastic foam defines a bottom surface of the mattress core, and the cover that extends around a periphery of the mattress core disposed between the top surface and the bottom surface.

8. The mattress core of claim 6, wherein the cover completely encases a top, a bottom, and a periphery of the mattress core.

9. The mattress core of claim 6, wherein the cover comprises a fireproof sock and/or ticking.

10. The mattress core of claim 1, wherein the pocketed or unpocketed coils comprise at least one of: symmetrical coils, single stranded coils, coil springs, asymmetrical coils, or multi-stranded coils.

11. The mattress core of claim 1, wherein the viscoelastic foam comprises a memory foam with a tight cell structure and/or a memory foam with an open cell structure.

12. The mattress core of claim 1, wherein the mattress core is sized to provide a mattress or mattress topper.

13. The mattress core of claim 1, wherein the first spacer fabric layer and the second spacer fabric layer each comprise two spaced apart fabrics joined by microfilaments.

14. A mattress topper comprising:

a first spacer fabric layer that defines a top surface of the mattress topper, wherein the first spacer fabric layer defines one or more first air channels that collectively provide a first cross-sectional area for airflow;

a second spacer fabric layer disposed beneath the first spacer fabric layer, wherein the second spacer fabric layer defines one or more second air channels that collectively provide a second cross-sectional area for airflow, and the first cross-sectional area has a first height that is larger than a second height of the second cross-sectional area;

a layer of coils consisting of pocketed or unpocketed coils disposed between and abutting both the first spacer fabric layer and the second spacer fabric layer;

a viscoelastic foam layer disposed beneath the second spacer fabric layer; and a cover that is wrapped around the first spacer fabric layer, the second spacer fabric layer, the layer of coils, and the viscoelastic foam layer.

15. The mattress topper of claim 14, wherein the mattress topper is a two-sided mattress topper and further comprises:

a third spacer fabric layer disposed beneath the viscoelastic foam layer;

a fourth spacer fabric layer disposed beneath the third spacer fabric layer; and a second layer of coils disposed between the third spacer fabric layer and the fourth spacer fabric layer.

16. A mattress comprising:

a first spacer fabric layer that defines a top surface of the mattress, wherein the first spacer fabric layer defines one or more first air channels that collectively provide a first cross-sectional area for airflow;

a second spacer fabric layer disposed beneath the first spacer fabric layer, wherein the second spacer fabric layer defines one or more second air channels that collectively provide a second cross-sectional area for airflow, and the first cross-sectional area has a first height that is larger than a second height of the second cross-sectional area;

a layer of coils consisting of pocketed or unpocketed coils disposed between and abutting both the first spacer fabric layer and the second spacer fabric layer;

a viscoelastic foam layer disposed beneath the second spacer fabric layer;

a polyurethane foam support layer disposed beneath the viscoelastic foam layer; and a cover that is wrapped around the first spacer fabric layer, the second spacer fabric layer, the layer of coils, the viscoelastic foam layer, and the polyurethane foam support layer.

17. The mattress of claim 16, wherein the mattress is a two-sided mattress and further comprises:

a third spacer fabric layer disposed beneath the polyurethane foam support layer;

a fourth spacer fabric layer disposed beneath the third spacer fabric layer; and a second layer of coils disposed between the third spacer fabric layer and the fourth spacer fabric layer.

* * * * *